US006148908A

United States Patent [19]

Brucher

[11] Patent Number: 6,148,908

[45] Date of Patent: Nov. 21, 2000

[54] HEAT EXCHANGER FOR COOLING A HOT PROCESS GAS

[75] Inventor: Peter Brucher, Oranienburg, Germany

[73] Assignee: Borsig GmbH, Berlin, Germany

[21] Appl. No.: 09/338,000

[22] Filed: Jun. 22, 1999

[30] Foreign Application Priority Data

Jul. 22, 1998 [DE] Germany ..... 198 33 004

[51] Int. Cl.[7] ..... F28F 9/02

[52] U.S. Cl. ..... 165/134.1; 165/154

[58] Field of Search ..... 165/154, 134.1, 165/173, 160

[56] References Cited

U.S. PATENT DOCUMENTS

| | | | |
|---|---|---|---|
| 4,026,006 | 5/1977 | Moebius | 29/508 |
| 5,025,546 | 6/1991 | Gotoh et al. | 29/508 |
| 5,088,551 | 2/1992 | Brucher et al. | 165/134.1 |
| 5,579,831 | 12/1996 | Brucher | 165/134.1 |
| 5,810,075 | 9/1998 | Deeke et al. | 165/134.1 |
| 5,813,453 | 9/1998 | Brucher | 165/134.1 |
| 5,816,322 | 10/1998 | Albano et al. | 165/134.1 |
| 5,826,647 | 10/1998 | Engelhardt et al. | 165/134.1 |

*Primary Examiner*—Ira S. Lazarus
*Assistant Examiner*—Terrell McKinnon
*Attorney, Agent, or Firm*—Thomas S. Baker, Jr.

[57] ABSTRACT

A heat exchanger (2) for cooling a hot process gas produced in a process gas generator (1) or a reactor is equipped with several cooling tubes (11), each of which is surrounded by an outer tube (12). Each cooling tube (11) and each outer tube (12) is welded at both ends to one water chamber (13, 14) each for feeding and draining of a cooling medium. The water chamber (13, 14) consists of a solid, strip-shaped piece into which, depending on the number of cooling tubes (11), circular wells (15) are introduced at a certain distance from one another. Each well (15) surrounds a cooling tube (11) and has a diameter equal to or larger than the inside diameter of the outer tube (12). The well (15) has a thin circular floor (16) of slight residual thickness in the area of the tube ends of the cooling tubes (11). A horizontal transfer line (4) carrying the hot process gas is connected to the the process gas generator (1). Each cooling tube (11) is accompanied by a coaxially arranged connecting tube (22) which projects into the cooling tube (11) on the one side and exits from the transfer line (4) on the other.

8 Claims, 3 Drawing Sheets

HEAT EXCHANGER FOR COOLING A HOT PROCESS GAS

Figure 1:
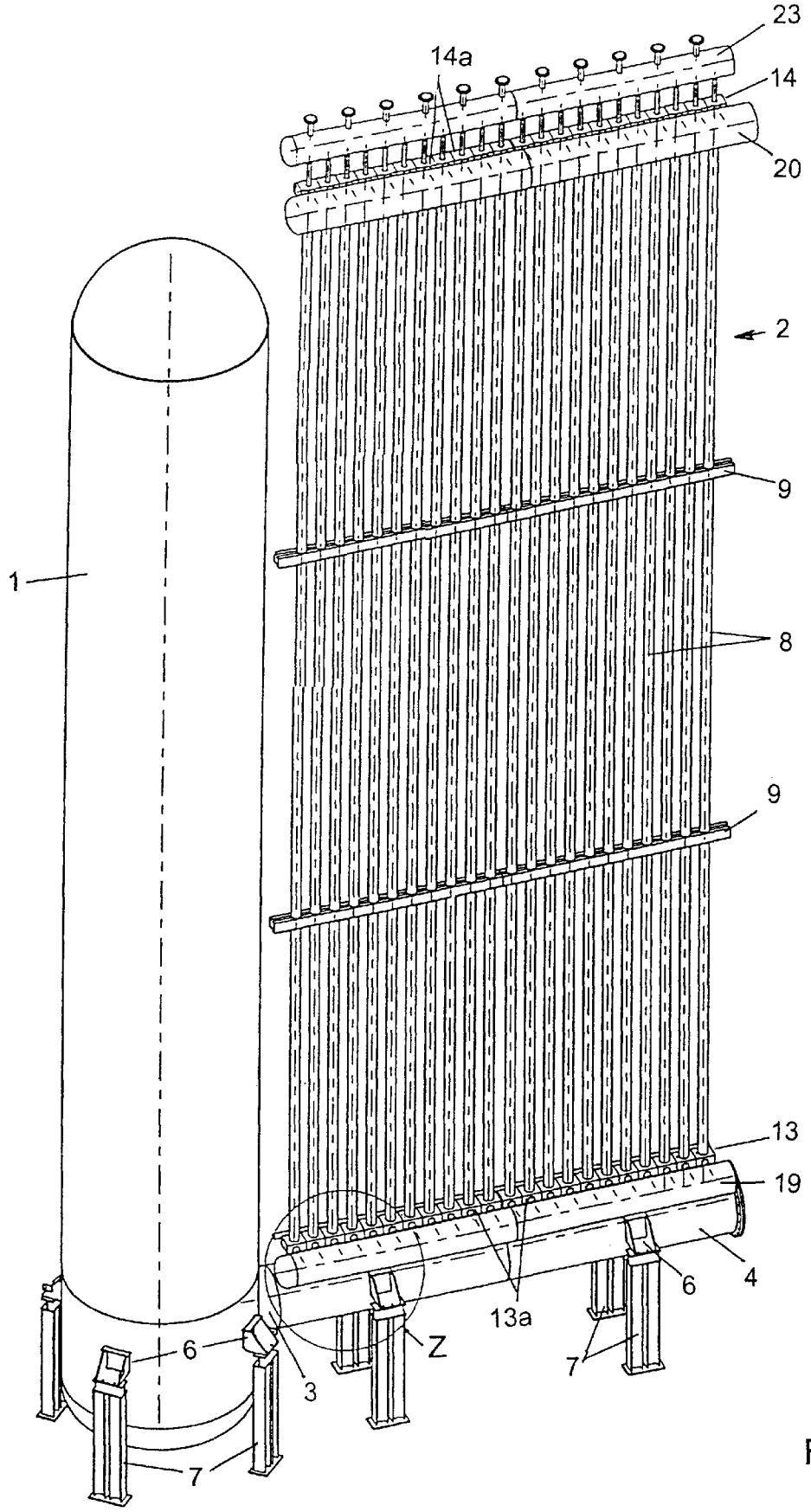

The invention relates to a heat exchanger for cooling a hot process gas produced in a process gas generator or a reactor, and having the characteristics as defined in Patent claim 1.

Hot process gases, generated in ammonia plants, in methanol plants, in hydrogen plants and in oil or residue gasification plants, are cooled in a waste-heat heat exchanger downstream from the reactor. The thermal energy contained in the process gas is recovered, generating high-pressure steam.

Known heat exchangers have a multitude of straight tube bundles through which the process gas flows. Here, the heat of the process gas dissipates into the water surrounding tube bundles inside the pressure shell, said water being under boiling pressure. The hot process gas is fed to a horizontal or vertical waste-heat heat exchanger via a process gas tube connected to the process gas generator. Waste-heat heat exchangers whose tubes are configured as a spiral are also known. All of these waste-heat heat exchangers are inherently expensive and also costly to maintain and repair.

From DE-OS 44 45 687 and DE-OS 196 22 139 [unexamined patent applications] we know of a heat exchanger with a linear double-tube register. Each of the two ends of the double tubes is welded to a water chamber consisting of a solid strip-shaped piece. Depending on the number of double tubes, wells are introduced into this solid piece at a certain distance from one another, with each well allocated to one double tube. The water chamber withstands the high pressure of the cooling medium and can be fabricated at a reasonable cost. The water chamber can consist of individual interconnected segments, making the segments as well as the double tubes accessible from all sides during manufacture. The known heat exchanger is used for cooling cracked gas in an ethylene plant. On the gas inlet side of the heat exchanger, each tube of the plant's cracking furnace is welded to the water chamber, coaxially to a double tube. This arrangement has the mentioned advantages and has proven itself in practice.

The objective of this invention is to configure the generic heat exchanger so that it can be used for different processes such as in ammonia plants, in methanol plants, in hydrogen plants or in oil or residue gasification plants, or for combustion processes.

For a generic heat exchanger, this task is solved, according to the invention, with the characteristics of Patent claim 1. Advantageous configurations of the invention are the object of the subclaims.

In the case of the heat exchanger according to the invention, the heat exchanger is connected to the process gas generator via a transfer line which is a structural element of simple design. This transfer line does not have to be adapted to the internal design of the process gas generator, nor does it require a special configuration of the heat exchanger. The heat exchanger can be standardized due to its relatively free configurability. In addition, the heat exchanger can be installed downstream from process gas generators in which different processes take place. This allows the heat exchanger to be used for cooling process gases from the manufacture of ammonia, the manufacture of methanol, the manufacture of hydrogen, or the gasification of oil or residues. The connecting tubes between the transfer line and the water chamber prevent the hot process gas from touching the floor of the water chamber.

Figure 3:
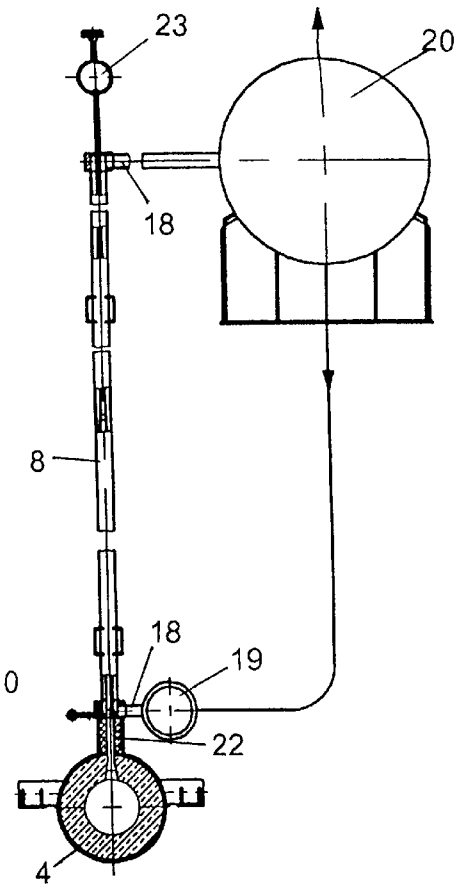
Figure 2:
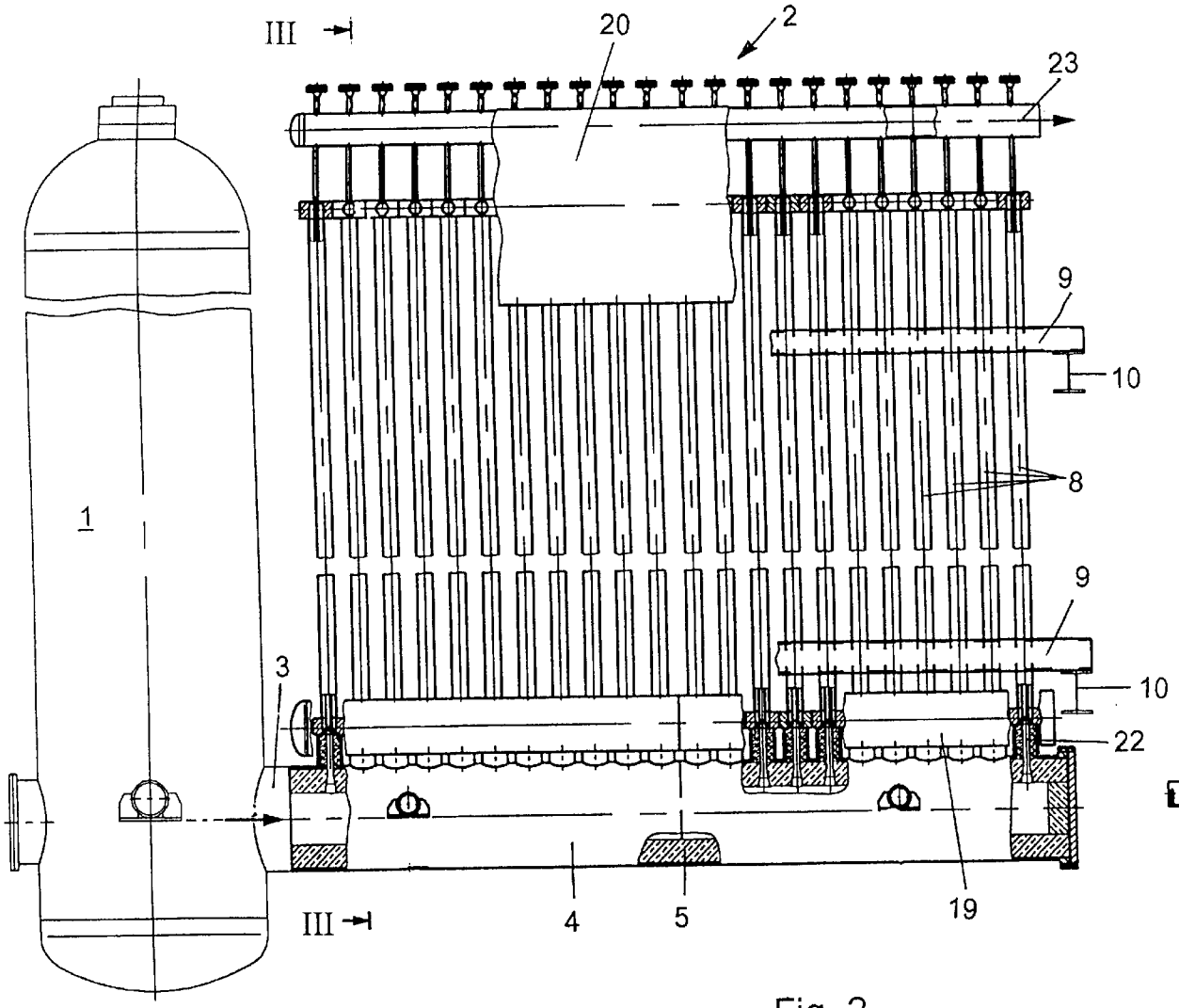
Figure 4:
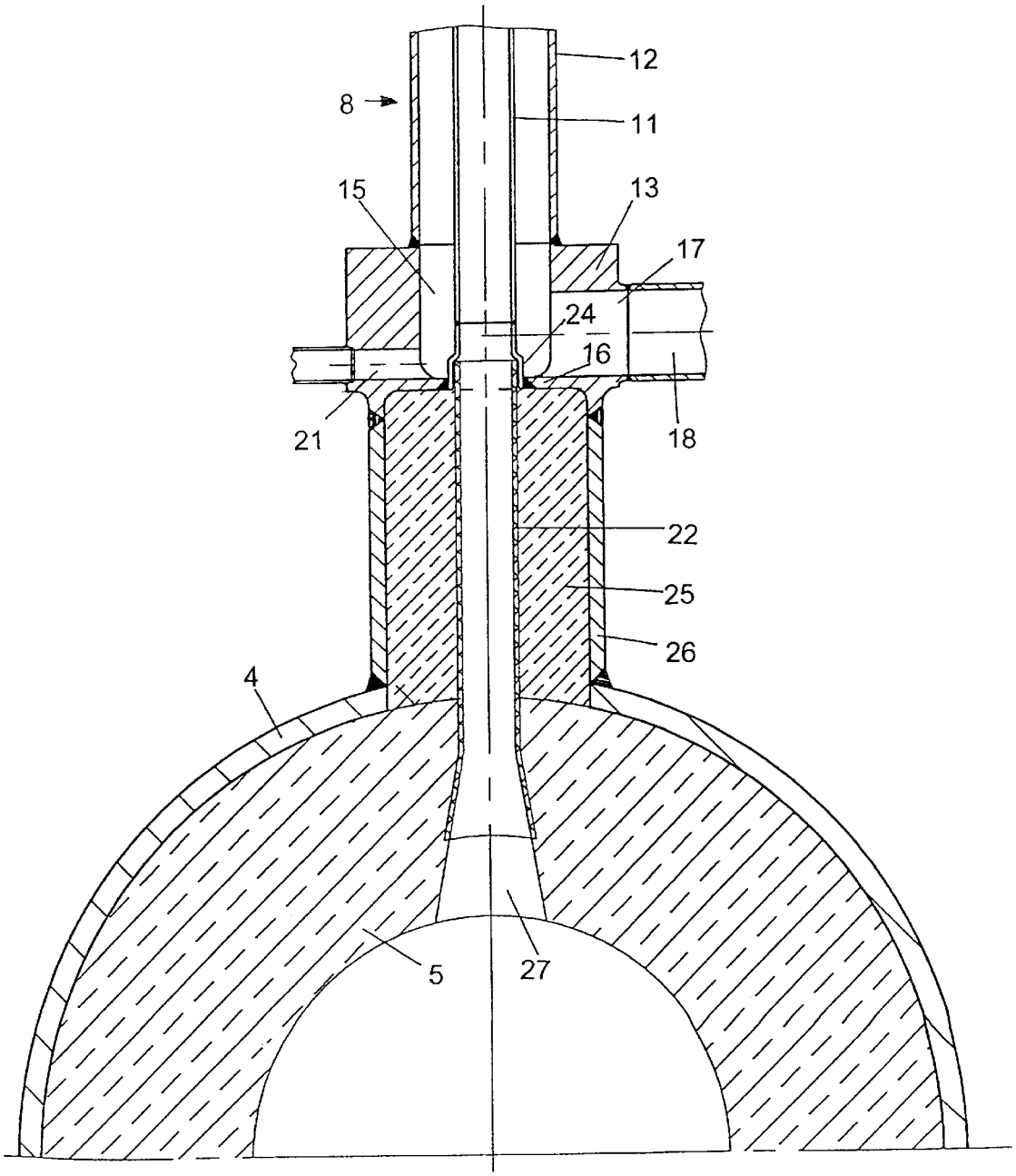

One configuration example of the invention is shown in the drawing and is explained in more detail below. Shown are:

FIG. 1 a heat exchanger with upstream process gas generator in perspective view FIG. 2 the heat exchanger with upstream process gas generator according to FIG. 1, partially in elevation and partially in longitudinal section FIG. 3 section III—III according to FIG. 2 and FIG. 4 detail Z according to FIG. 1.

In a process gas generator 1 belonging to an oil- or residue gasification plant, for instance, hot process gases are produced which are cooled in a downstream heat exchanger 2. The process gas generator 1 is of upright design and equipped with a gas outlet connecting piece 3 in its lower part. The heat exchanger 2 can also be installed downstream from a reactor for producing ammonia, methanol or hydrogen.

A horizontal transfer line 4 of circular diameter is connected to the gas outlet connecting piece 3 of the process gas generator 1. The transfer line 4 is equipped with a refractory, heat-insulating lining 5. On the outside of the transfer line 4 and also the process gas generator 1, lugs 6 are installed which allow the transfer line 4 and the process gas generator 1 to rest on supports 7.

The heat exchanger 2 contains double tubes 8, arranged next to each other in a row. The double tubes 8 are connected by means of bands 9, which rest on brackets 10.

Each double tube 8 consists of a cooling tube 11 which is surrounded by an outer tube 12 at a certain distance, forming an annulus. Both the outer tube 12 and the cooling tube 11 are tightly welded at both ends to one water chamber 13, 14 each for intake and outlet of a cooling medium. The water chamber 13, 14 consists of a solid strip-shaped piece, into which circular wells 15 are introduced at a certain distance from one another, each of which surrounds a single cooling tube 11. The diameter of the well 15 is equal to or larger than the inside diameter of the outer tube 12. In the area of the tube ends of the cooling tubes 11, the well 15 has a thin, annular floor 16 of slight residual thickness. The cooling tube 11 is welded into this floor 16. The outer tube 12 is welded to the water chamber 13, 14 on the side facing away from the thin floor 16.

The strip-shaped piece forming the water chamber 13, 14 preferably consists of individual rectangular or square segments connected to each other by welding, for instance. A single well 15, surrounding a cooling tube 11, is introduced into each segment of the water chamber 13, 14.

A bore hole 17 leads into each well 15 at the level of the floor 16, preferably tangentially. The bore holes 17 each are connected via a coupling to a collector 19 for supplying a cooling medium, or to a steam collecting drum 20 for carrying off the cooling medium. The well 15 has another bore hole 21, leading to the outside at the level of the floor 16 and is connected to an elutriation line (not shown), which can be shut off.

On the gas intake side, the cooling tubes 11 are connected to the transfer line 4 via ceramic connecting tubes, for instance, and on the gas outlet side, to a gas collecting tube 23. The connecting tubes 22 are arranged coaxially to the cooling tubes 11. They preferably have the same inside diameter as the cooling tubes 11. Each connecting tube 22 projects—at a radial and axial distance—into a tube expansion 24, which is located at the inlet-side end of each cooling tube 11.

Each connecting tube 22 is surrounded by a refractory, heat-insulating layer 25. This layer 25 is enclosed by a tube segment 26, which is welded to the lower water chamber 13 and to the transfer line 4.

The inlet-side expanding end of the connecting tubes 22 is held in the interior lining 5 of transfer line 4 and is connected to the cross-section of the transfer line 4 carrying the process gas via an opening 27 in the interior lining 5.

The process gas generator 1 can also be replaced by a gas or oil burner. In this case, the heat exchanger 2 can be operated as a fired auxiliary boiler.

What is claimed is:

1. Heat exchanged for cooling a hot process gas, produced in a process gas generator or a reactor, by means of several cooling tubes, each of which is surrounded by an outer tube, with each cooling tube and each outer tube welded at both ends to one water chamber each for intake and outlet of a cooling medium, and the water chamber consisting of a solid, strip-shaped piece, into which, depending on the number of cooling tubes, circular wells are introduced at a certain distance from one another, with each well surrounding a cooling tube and having a diameter equal to or larger than the inside diameter of the outer tube, and the well having a thin circular floor of slight residual thickness in the area of the tube ends of the cooling tubes, characterized by the fact that a horizontal transfer line carrying the hot process gas is connected to the process gas generator, and that, coaxial to each cooling tube, there is a connecting tube which enters the cooling tube on the one side and exits the transfer line on the other.

2. Heat exchanger according to claim 1, characterized in that the transfer line has a refractory interior lining and each connecting tube is surrounded by a refractory layer.

3. Heat exchanger according to claim 1, characterized in that one end of each cooling tube ends in a tube expansion which is welded into the thin floor, and that one connecting tube each projects into the tube expansion at a radial and axial distance.

4. Heat exchanger according to claim 1, characterized in that the transfer line is connected to a burner.

5. Heat exchanger according to claim 2, characterized in that one end of each cooling tube ends in a tube expansion which is welded into the thin floor, and that one connecting tube each projects into the tube expansion at a radial and axial distance.

6. Heat exchanger according to claim 2, characterized in that the transfer line is connected to a burner.

7. Heat exchanger according to claim 3, characterized in that the transfer line is connected to a burner.

8. Heat exchanger according to claim 5, characterized in that the transfer line is connected to a burner.

* * * * *